US010022989B2

(12) United States Patent
Imamura et al.

(10) Patent No.: US 10,022,989 B2
(45) Date of Patent: Jul. 17, 2018

(54) PRINTING APPARATUS AND PRINTING METHOD

(71) Applicant: SEIKO EPSON CORPORATION, Tokyo (JP)

(72) Inventors: Atsushi Imamura, Shiojiri (JP); Naoki Hori, Matsumoto (JP); Masashi Oba, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/616,790

(22) Filed: Jun. 7, 2017

(65) Prior Publication Data

US 2017/0355204 A1 Dec. 14, 2017

(30) Foreign Application Priority Data

Jun. 9, 2016 (JP) ..... 2016-114927

(51) Int. Cl.
*B41J 11/42* (2006.01)
*B41J 13/00* (2006.01)

(52) U.S. Cl.
CPC ..... *B41J 13/0009* (2013.01); *B41J 11/42* (2013.01)

(58) Field of Classification Search
CPC . B41J 13/0009; B41J 2/01; B41J 29/38; B41J 11/42; B41J 29/393
See application file for complete search history.

(56) References Cited

U.S. PATENT DOCUMENTS 8,876,240 B2 * 11/2014 Imamura ..... B41J 13/0009 347/16
2013/0278665 A1 10/2013 Imamura

FOREIGN PATENT DOCUMENTS

JP 10-086472 4/1998
JP 2013-220645 10/2013

* cited by examiner

*Primary Examiner* — Huan Tran
(74) *Attorney, Agent, or Firm* — Workman Nydegger

(57) ABSTRACT

A printing apparatus includes: a driving roller configured to drive a recording medium by rotation thereof while being in contact with the recording medium; a discharging head configured to discharge liquid onto a recording medium; a driven rotational member configured to be driven to rotate as a result of transport of the recording medium while being in contact with the recording medium; a rotation position detection unit configured to detect a rotation position of the driven rotational member; and a control unit configured to rotate the driving roller to transport the recording medium and adjust a timing of discharging the liquid from the discharging head in accordance with a detection result of the rotation position detection unit. The control unit adjusts a rotational speed of the driving roller in accordance with a linear pressure applied to the recording medium on the driving roller.

9 Claims, 9 Drawing Sheets

FIG. 4

| TYPE OF SHEET S | | COEFFICIENT a | COEFFICIENT b |
|---|---|---|---|
| SHEET S INCLUDING PAPER | PAPER + PAPER | 0.055 | 0.374 |
| | SINGLE LAYER PAPER | | |
| | F + PAPER | | |
| SHEET S NOT INCLUDING PAPER | F+F | 0.297 | 0.254 |
| | SINGLE LAYER F | 1.422 | 0.123 |

PRINTING APPARATUS AND PRINTING METHOD

BACKGROUND

1. Technical Field

The present invention relates to technology for performing printing by discharging liquid onto a recording medium while transporting the recording medium.

A printing apparatus disclosed in JP-A-2013-220645 prints an image on a recording medium by discharging liquid from a discharging head onto the recording medium being transported in a specific transport direction. In this type of printing apparatus, the liquid is required to be discharged from the discharging head at a timing that accords with a transport speed of the recording medium over an impact range in which the liquid discharged from the discharging head makes an impact. Thus, a driven rotational member is provided corresponding to this impact range, and the discharge timing of the liquid from the discharging head is controlled on the basis of a result of detecting a rotation position of the driven rotational member, which rotates due to the transport of the recording medium.

However, a time interval over which the discharging head can continuously discharge the liquid in an appropriate manner is limited. Therefore, if the transport speed of the recording medium is too fast, discharging the liquid appropriately from the discharging head becomes difficult. Here, the printing apparatus disclosed in JP-A-2013-220645 adjusts the transport speed of the recording medium by controlling the rotational speed of a driving roller that drives the recording medium in the transport direction.

According to this type of configuration, the circumferential speed of the driven rotational member provided corresponding to the impact range of the liquid may match, in principle, the circumferential speed of the driving roller. However, according to experiments conducted by the inventors of the present application, the inventors can verify that, depending on conditions when the recording medium is transported, the circumferential speed of the driving roller and the circumferential speed of the driven rotational member do not necessarily match each other. In particular, the inventors can find that, depending on a linear pressure applied to the recording medium from the driving roller, the circumferential speed of the driven rotational member is sometimes faster than the circumferential speed of the driving roller. In other words, sometimes, the transport speed of the recording medium over the impact range in which the driven rotational member is correspondingly provided becomes too fast.

SUMMARY

An advantage of some aspects of the invention is that, in relation to printing technology that adjusts a discharge timing of liquid from a discharging head in accordance with a rotation position of a driven rotational member that rotates due to the transport of a recording medium while a transport speed of the recording medium is controlled using a driving roller, the transport speed of the recording medium with respect to the driven rotational member can be controlled to be within an appropriate range. According to a first aspect of the invention, a printing apparatus includes: a driving roller configured to transport a recording medium by rotation of the driving roller while being in contact with the recording medium; a discharging head configured to discharge liquid onto the recording medium; a driven rotational member configured to be driven to rotate as a result of transport of the recording medium while being in contact with the recording medium; a rotation position detection unit configured to detect a rotation position of the driven rotational member; and a control unit configured to rotate the driving roller to transport the recording medium and adjust a timing of discharging the liquid from the discharging head in accordance with a detection result of the rotation position detection unit. The control unit adjusts a rotational speed of the driving roller in accordance with a linear pressure applied to the recording medium on the driving roller.

According to a second aspect of the invention, a printing method includes: transporting a recording medium by rotating a driving roller in contact with the recording medium, and also detecting a rotation position of a driven rotational member driven to rotate as a result of transport of the recording medium while being in contact with the recording medium; and adjusting a timing of discharging liquid from a discharging head on the recording medium in accordance with a detection result of the rotation position of the driven rotational member. A rotational speed of the driving roller is adjusted in accordance with a linear pressure applied to the recording medium on the driving roller.

In the invention configured in this manner (the first aspect and the second aspect), the rotational speed of the driving roller is adjusted in accordance with the linear pressure applied to the recording medium on the driving roller. Thus, a transport speed of the recording medium on the driven rotational member can be suppressed to an appropriate range.

Note that, various specific arrangement locations of the driven rotational member are conceivable. For example, the printing apparatus may be configured such that the recording medium is wrapped around and supported on a circumferential surface of the driven rotational member, and the discharging head discharges the liquid onto the recording medium wrapped around the driven rotational member.

Note that, various specific methods for adjusting the rotational speed of the driving roller in accordance with the linear pressure applied to the recording medium on the driving roller are conceivable. For example, the printing apparatus may include: a tension adjustment unit configured to adjust a tension of the recording medium on a side closer to the discharging head than the driving roller to a first target tension T1, and also adjust a tension of the recording medium on an opposite side to the discharging head with respect to the driving roller to a second target tension T2, the second target tension T2 being smaller than the first target tension T1. The control unit may adjust the rotational speed of the driving roller in accordance with a linear pressure Pl calculated using an expression $$(T1-T2)/W,$$

where a difference between the first target tension T1 and the second target tension T2 is divided by a width of the recording medium. In this way, the transport speed of the recording medium on the driven rotational member can be suppressed to the appropriate range.

Incidentally, according to experiments conducted by the inventors, the inventors can find that a circumferential speed of the driven rotational member is sometimes faster than a circumferential speed of the driving roller, depending on a type of recording medium. Here, the printing apparatus may be configured such that the control unit adjusts the rotational speed of the driving roller in accordance with the type of recording medium. In this way, the transport speed of the recording medium on the driven rotational member can be more reliably suppressed to the appropriate range.

At this time, various specific methods for adjusting the rotational speed of the driving roller in accordance with the type of recording medium are conceivable. For example, the printing apparatus may be configured such that the control unit uses a coefficient a and a coefficient b, the coefficient a and the coefficient b each being greater than zero, and adjusts the rotational speed of the driving roller in accordance with a control amount calculated using an expression $$a \times Pl + b,$$

and also changes at least one of the coefficient a and the coefficient b in accordance with the type of recording medium. In this way, the transport speed of the recording medium on the driven rotational member can be more reliably suppressed to the appropriate range.

More specifically, the printing apparatus may be configured such that the coefficient a used when a recording medium that does not include paper is used as the recording medium is greater than the coefficient a used when a recording medium that includes paper is used as the recording medium, and the coefficient b used when a recording medium that does not include paper is used as the recording medium is less than the coefficient b used when a recording medium that includes paper is used as the recording medium.

Note that, the plurality of structural elements of each of the modes of the above-described invention are not all essential, and, to solve part or all of the above-described problems, or to achieve all or part of the effects described in the present specification, some of the plurality of structural elements may be changed, omitted or replaced with other structural elements, as necessary, and some of a limited amount of content can be omitted. Further, to solve part or all of the above-described problems, or to achieve all or part of the effects described in the present specification, part or all of the technical features included in one of the above-described embodiments of the invention can be combined with part or all of the technical features of another one of the above-described embodiments of the invention, and can also be used as an independent embodiment of the invention.

BRIEF DESCRIPTION OF THE DRAWINGS

The invention will be described with reference to the accompanying drawings, wherein like numbers reference like elements.

FIG. 4 is a diagram illustrating a table showing relationships between sheet types and coefficients a and b.

DESCRIPTION OF EMBODIMENTS

Figure 1:
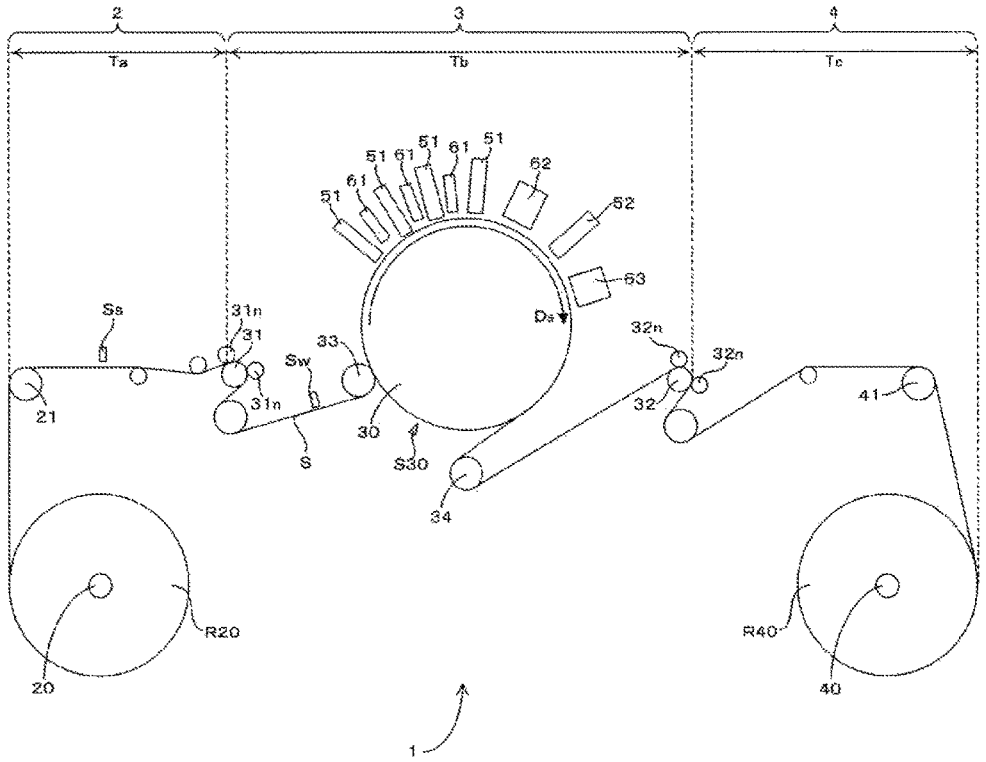
FIG. 1 is a front view illustrating an internal configuration of a printer to which the invention is applied.

FIG. 1 is a front view schematically illustrating an internal configuration of a printer to which the invention is applied. As illustrated in FIG. 1, in a printer 1, a single sheet S (web) is stretched between a feeding shaft 20 and a winding shaft 40 and both ends of the sheet S are wound into a roll shape around the feeding shaft 20 and the winding shaft 40. The sheet S is transported from the feeding shaft 20 to the winding shaft 40. In other words, both the ends of the sheet S are each wound into the roll shape, thus forming a feeding roll R20 and a winding roll R40, and the sheet S is transported using the roll-to-roll method along a transport direction Ds from the feeding roll R20 supported by the feeding shaft 20 toward the winding roll R40 supported by the winding shaft 40.

Then, in the printer 1, an image is recorded on the sheet S being transported in the transport direction Ds. Paper or a film may be used as the material of the sheet S. More specifically, the paper may be woodfree paper, cast coated paper, art paper, coat paper or the like, and the film may be synthetic paper, polyethylene terephthalate (PET), polypropylene (PP) or the like. Note that, in the present specification, a type of sheet S configured by layering two sheets of paper is denoted by "paper+paper," a type of sheet S configured by a single layer of paper is denoted by "single layer paper," a type of sheet S configured by layering a film and paper is denoted by "F+paper," a type of sheet S configured by layering two sheets of film is denoted by "F+F," and a type of sheet S configured by a single layer of film is denoted by "single layer F." Further, in the description below, of both surfaces of the sheet S, a surface on a side facing recording heads 51 and 52 (to be described later) is referred to as a top surface and a surface on the reverse side is referred to as a back surface.

In brief, the printer 1 is provided with a feeding unit 2 (a feeding area) that feeds the sheet S from the feeding shaft 20, a processing unit 3 (a processing area) that records an image on the sheet S fed from the feeding unit 2, and a winding unit 4 (a winding area) that winds the sheet S, on which the image has been printed by the printing unit 3, onto the winding shaft 40.

The feeding unit 2 includes the feeding shaft 20 on which the end of the sheet S is wound, and a driven roller 21 around which the sheet S pulled out from the feeding shaft 20 is wrapped. The end of the sheet S is wound onto the feeding shaft 20 with the top surface of the sheet S facing outward, and the feeding shaft 20 supports the sheet S. Then, by the feeding shaft 20 rotating in the clockwise direction in FIG. 1, the sheet S wound on the feeding shaft 20 is fed to the processing unit 3 via the driven roller 21. Further, an edge sensor Ss, which detects a position of an edge of the sheet S in the width direction, is provided in the feeding unit 2. Here, the width direction is a direction orthogonal to the transport direction Ds and to a normal line of the sheet S, and is the vertical direction with respect to the paper surface in FIG. 1.

The processing unit 3 prints the image on the sheet S by performing processing as appropriate using each of the functional portions 51 and 52 and functional portions 61, 62, and 63 disposed along an outer circumferential surface of a rotating drum 30, while supporting the sheet S fed from the feeding unit 2 on the rotating drum 30. In the processing unit 3, a front driving roller 31 and a rear driving roller 32 are provided on both sides of the rotating drum 30, and the sheet S transported from the front driving roller 31 to the rear driving roller 32 and supported on the rotating drum 30 is subject to the image recording.

The outer circumferential surface of the front driving roller 31 has a plurality of minute protrusions formed by thermal spraying, and the front driving roller 31 supports the sheet S fed from the feeding unit 2 from the back surface thereof. Then, by the front driving roller 31 rotating in the clockwise direction in FIG. 1, the sheet S fed from the feeding unit 2 is transported to the downstream side in the transport direction Ds. Two nip rollers 31*n* are provided with respect to the front driving roller 31. These nip rollers 31*n* are arranged side by side and separated from each other in the circumferential direction of the front driving roller 31, and come into contact with the sheet S wrapped around the circumferential surface of the front driving roller 31. Further, each of the nip rollers 31*n* are urged toward the front driving roller 31, and the sheet S is gripped between the nip rollers 31*n* and the front driving roller 31. In this way, a frictional force between the front driving roller 31 and the sheet S is secured, and the transport of the sheet S by the front driving roller 31 can be reliably performed.

The rotating drum 30 is rotatably supported by a support mechanism that is not illustrated, and is, for example, a cylindrical drum having a diameter of 400 mm. The sheet S transported from the front driving roller 31 to the rear driving roller 32 is wrapped around the circumferential surface of the rotating drum 30, from the back surface of the sheet S. This rotating drum 30 supports the sheet S from the back surface while being driven to rotate in the transport direction Ds of the sheet S due to the frictional force between the rotating drum 30 and the sheet S. Incidentally, in the processing unit 3, driven rollers 33 and 34 are provided that bend back the sheet S on both sides of a wrapped around section of the rotating drum 30. Of these, the driven roller 33 bends back the sheet S due to the top surface of the sheet S being wrapped around between the front driving roller 31 and the rotating drum 30. Meanwhile, the driven roller 34 bends back the sheet S due to the top surface of the sheet S being wrapped around between the rotating drum 30 and the rear driving roller 32. In this way, the sheet S is bent back at each of the upstream and the downstream sides of the rotating drum 30 in the transport direction Ds, and the wrapped around section of the sheet S on the rotating drum 30 can be maintained to be long. Further, a paper width sensor Sw is provided on the upstream side of the driven roller 33 in the transport direction Ds, and the paper width sensor Sw detects a width dimension, specifically, a width W, of the sheet S in the width direction. In addition, a temperature sensor S30 is provided facing a section of the circumferential surface of the rotating drum 30 around which the sheet S is not wrapped and which is thus exposed. The temperature sensor S30 is, for example, a radiation thermometer, and detects the temperature of the circumferential surface of the rotating drum 30.

The outer circumferential surface of the rear driving roller 32 has a plurality of minute protrusions formed by thermal spraying, and the rear driving roller 32 supports the sheet S transported from the rotating drum 30 via the driven roller 34, from the back surface thereof. Then, by the rear driving roller 32 rotating in the clockwise direction in FIG. 1, the sheet S is transported toward the winding unit 4. Two nip rollers 32*n* are provided with respect to the rear driving roller 32. These nip rollers 32*n* are arranged side by side and separated from each other in the circumferential direction of the rear driving roller 32, and come into contact with the sheet S wrapped around the circumferential surface of the rear driving roller 32. Further, each of the nip rollers 32*n* are urged toward the rear driving roller 32, and the sheet S is gripped between the nip rollers 32*n* and the rear driving roller 32. In this way, a frictional force between the rear driving roller 32 and the sheet S is secured, and the transport of the sheet S by the rear driving roller 32 can be reliably performed.

In this way, the sheet S transported from the front driving roller 31 to the rear driving roller 32 is supported on the outer circumferential surface of the rotating drum 30. Further, a plurality of recording heads 51 each corresponding to different colors are provided in the processing unit 3, to record a color image on the top surface of the sheet S supported by the rotating drum 30. Specifically, four of the recording heads 51, corresponding to yellow, cyan, magenta, and black, are arranged side by side in this order of colors in the transport direction Ds. Each of the recording heads 51 faces the top surface of the sheet S wrapped around the rotating drum 30 with a slight clearance therebetween, and discharges ink (colored ink) of the corresponding color from nozzles, using the ink jet method. Then, by each of the recording heads 51 discharging the ink onto the sheet S transported in the transport direction Ds, the color image is formed on the top surface of the sheet S.

Incidentally, ultraviolet (UV) ink (photocurable ink), which is cured by being irradiated with ultraviolet rays (light), is used as the ink. Here, in the processing unit 3, to cure the ink and fix the ink on the sheet S, UV irradiators 61 and 62 (light irradiation units) are provided. Note that this ink curing is divided and performed in two stages, of temporary curing and final curing. The UV irradiators 61 for the temporary curing are disposed between each of the plurality of recording heads 51. Specifically, the UV irradiators 61 cure (temporarily cure) the ink to an extent that a shape of the ink does not collapse, by irradiating UV rays having a low integral of light, and do not completely cure the ink. Meanwhile, the UV irradiator 62 for the final curing is provided on the downstream side, in the transport direction Ds, of the plurality of recording heads 51. Specifically, the UV irradiator 62 completely cures (finally cures) the ink, by irradiating UV rays having a higher integral of light than that of the UV irradiators 61.

In this way, the UV irradiators 61 disposed between each of the plurality of recording heads 51 temporarily cure the colored inks discharged onto the sheet S from the recording heads 51 on the upstream side in the transport direction Ds. Thus, the ink discharged onto the sheet S by one of the recording heads 51 is temporarily cured before it reaches the recording head 51 adjacent, on the downstream side in the transport direction Ds, to the one recording head 51. This configuration suppresses the occurrence of color mixing resulting from the mixing of colored inks of different colors. With the color mixing being suppressed in this way, the plurality of recording heads 51 discharge the colored inks of the mutually different colors, and form the color image on the sheet S. Meanwhile, the UV irradiator 62 for the final curing is provided on the downstream side, in the transport direction Ds, of the plurality of recording heads 51. Thus, the color image formed by the plurality of recording heads 51 is fixed on the sheet S by being finally cured by the UV irradiator 62.

In addition, the recording head 52 is provided on the downstream side, in the transport direction Ds, of the UV irradiator 62. The recording head 52 faces the top surface of the sheet S wrapped around the rotating drum 30 with a slight clearance therebetween, and discharges transparent UV ink from nozzles onto the top surface of the sheet S, using the ink jet method. Specifically, the transparent ink is further discharged onto the color image formed by the recording heads 51 of the four colors. This transparent ink is discharged over the entire color image, and imparts a quality of a shiny appearance or a matt appearance to the color image. Meanwhile, a UV irradiator 63 is provided on the downstream side, in the transport direction Ds, of the recording head 52. Specifically, the UV irradiator 63 completely cured (finally cures) the transparent ink discharged by the recording head 52, by irradiating strong UV rays. By doing this, the transparent ink is fixed on the top surface of the sheet S.

In this way, in the processing unit 3, by the discharge of the inks by the recording heads 51 and 52, and the curing of the inks by the UV irradiators 61 to 63, the color image coated by the transparent ink is formed on the sheet S supported by being wrapped around the circumferential surface of the rotating drum 30. Then, the sheet S on which the color image has been formed is transported by the rear driving roller 32 to the winding unit 4.

In addition to the winding shaft 40 on which the end of the sheet S is wound, the winding unit 4 includes a driven roller 41 around which the sheet S is wrapped from the back surface side, between the winding shaft 40 and the rear driving roller 32. The end of the sheet S is wound onto the winding shaft 40 with the top surface of the sheet S facing outward, and the winding shaft 40 supports the sheet S. Specifically, by the winding shaft 40 rotating in the clockwise direction in FIG. 1, the sheet S transported from the rear driving roller 32 is wound onto the winding shaft 40 via the driven roller 41.

Figure 2:
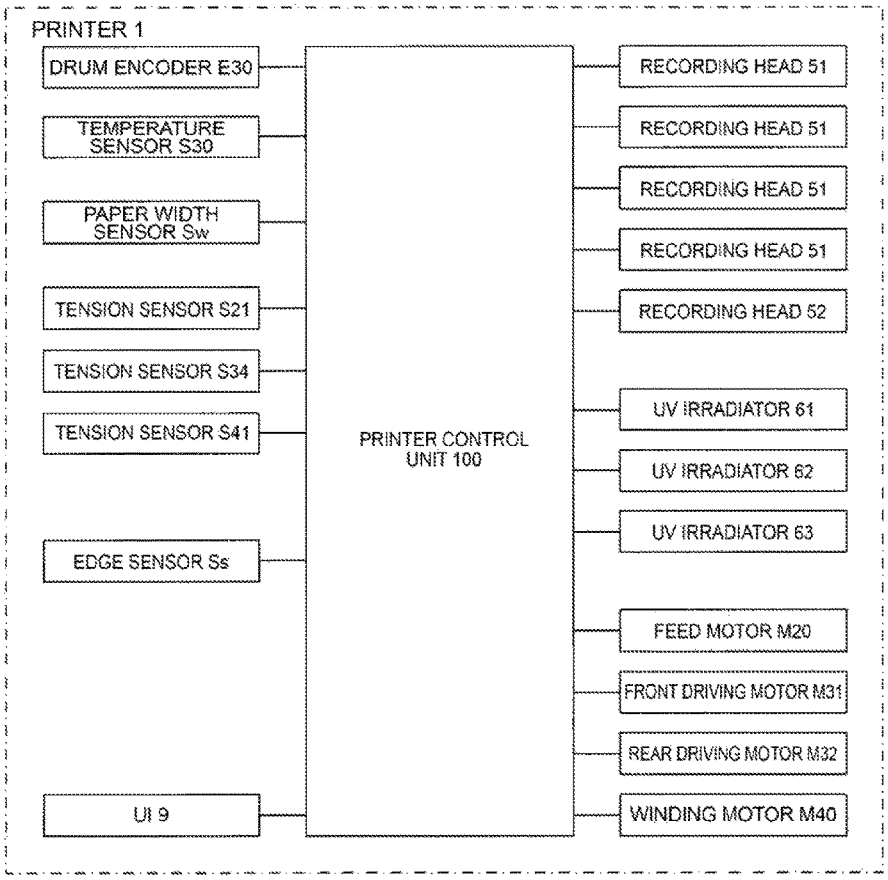
FIG. 2 is a block diagram illustrating an electrical configuration of the printer illustrated in FIG. 1.

The above is an outline description of the device configuration of the printer 1. Next, the electrical configuration controlling the printer 1 will be described with reference to FIG. 2. FIG. 2 is a block diagram illustrating the electrical configuration of the printer 1 illustrated in FIG. 1. The printer 1 includes a printer control unit 100 that performs overall control of each of the units and portions of the device. This printer control unit 100 is a computer configured by a central processing unit (CPU) and a memory.

Further, the printer 1 is provided with a user interface (UI) 9. The UI 9 includes a monitor configured by a liquid crystal display and the like, and an input operating portion configured by a keyboard, a mouse, and the like. Then, in addition to an image to be printed, a menu screen is displayed on the monitor of the UI 9. Thus, a user can open a print settings screen, and can set a type of printing medium, a size of the printing medium, and various types of printing condition such as a type of print medium, a size of a printing medium, print quality and the like, by operating the input operating portion of the UI 9 while checking the monitor of the UI 9. Note that various modifications can be made to a specific configuration of the UI 9, and a touch panel type display may be used as the monitor, and the input operating portion of the monitor may be configured by the touch panel. Then, as described below, the printer control unit 100 controls the various units and portions of the devices, such as the recording heads 51 and 52, the UV irradiators 61 to 63, and a sheet transport system, in accordance with instructions from an external device or input operations on the UI 9.

The printer control unit 100 controls the ink discharge timing of each of the recording heads 51 that form the color image, in accordance with the transport of the sheet S. Specifically, this ink discharge timing control is performed on the basis of an output (a detection value) of a drum encoder (a rotary encoder) E30 attached to a rotating shaft of the rotating drum 30 and detects a rotation position of the rotating drum 30. In other words, since the rotating drum 30 is driven to rotate in accordance with the transport of the sheet S, a transport position of the sheet S can be ascertained by referring to the output of the drum encoder E30 that detects the rotation position of the rotating drum 30. Here, the printer control unit 100 generates, from the output of the drum encoder E30, a signal known as a print timing signal (pts), and controls the ink discharge timing of each of the recording heads 51 on the basis of the pts, thus causing the ink discharged from each of the recording heads 51 to impact at a target position on the transported sheet S, and forming the color image.

Figure 3:
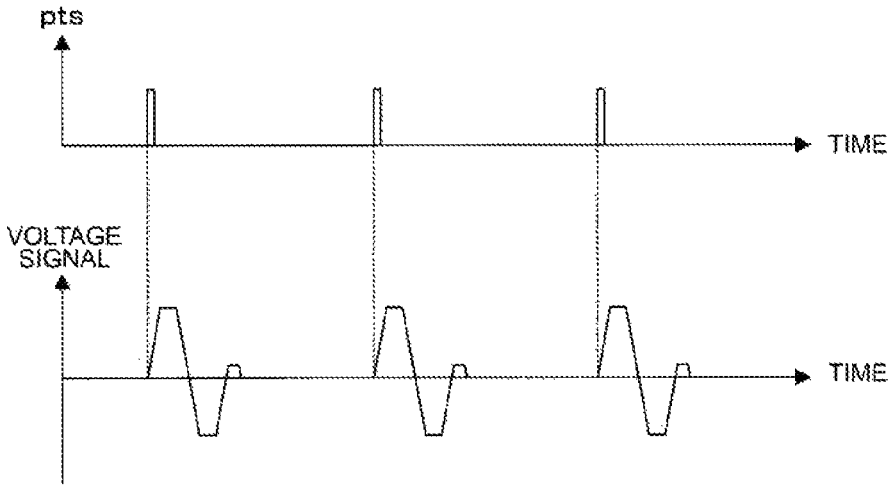
FIG. 3 is a diagram illustrating an example of control to adjust an ink discharge timing of a recording head.

FIG. 3 is a timing chart schematically illustrating a control to adjust the timing at which the recording head 51 discharges the ink. As illustrated in FIG. 3, the printer control unit 100 applies a voltage signal to the nozzles of the recording head 51 in synchronization with the pts generated from the output of the drum encoder E30, and the nozzles of the recording head 51 receive the voltage signal and discharge the ink. According to this control, if the rotational speed of the rotating drum 30 fluctuates, an output interval of the pts changes, and an interval at which the voltage signal is applied to the nozzles of the recording head 51 also changes. In this way, the ink can be discharged from the recording head 51 at a timing that accords with the rotational speed of the rotating drum 30, and the ink can be caused to impact the sheet S at an appropriate position.

The description will be continued below while returning to FIG. 1 and FIG. 2. Similar to the recording head 51, the timing at which the recording head 52 discharges the transparent ink is also controlled by the printer control unit 100 on the basis of the output of the drum encoder E30. In this way, the transparent ink is appropriately discharged onto the color image formed by the plurality of recording heads 51. In addition, a timing of lighting and extinguishing the UV irradiators 61, 62, and 63 and an amount of irradiated light are also controlled by the printer control unit 100.

Further, the printer control unit 100 has a function to control the transport of the sheet S as described in detail above with reference to FIG. 1. Specifically, of the members configuring the sheet transport system, motors are each connected to the feeding shaft 20, the front driving roller 31, the rear driving roller 32, and the winding shaft 40. Then, the printer control unit 100 controls a speed (a rotational speed) and torque of each of the motors while rotating these motors, and controls the transport of the sheet S. This transport control of the sheet S is described in detail below.

The printer control unit 100 rotates a feed motor M20 that drives the feeding shaft 20, and supplies the sheet S to the front driving roller 31 from the feeding shaft 20. At this time, the printer control unit 100 controls the torque of the feed motor M20 and adjusts a tension (a feed tension Ta) of the sheet S from the feeding shaft 20 to the front driving roller 31. Specifically, a tension sensor S21 that detects the feed tension Ta is attached to the driven roller 21 disposed between the feeding shaft 20 and the front driving roller 31. This tension sensor S21 can be configured, for example, by a load cell that detects a force received from the sheet S. Then, on the basis of a detection result of the tension sensor S21, the printer control unit 100 performs feedback control of the torque of the feed motor M20, and adjusts the feed tension Ta of the sheet S. Specifically, a target feed tension Tat, which has been input by the user via the UI 9, is stored in the printer control unit 100. Then, the printer control unit 100 performs the feedback control of the torque of the feed motor M20, such that the feed tension Ta detected by the tension sensor S21 approaches the target feed tension Tat.

Further, the printer control unit 100 rotates a front driving motor M31 that drives the front driving roller 31, and a rear driving motor M32 that drives the rear driving roller 32. In this way, the sheet S fed from the feeding unit 2 passes through the processing unit 3 in the transport direction Ds. At this time, a speed control that will be described in detail later is performed on the front driving motor M31, while the following torque control is performed on the rear driving motor M32.

The printer control unit 100 controls the torque of the rear driving motor M32 and adjusts a tension (a processing tension Tb) of the sheet S from the front driving roller 31 to the rear driving roller 32. Specifically, a tension sensor S34 that detects the processing tension Tb is attached to the driven roller 34 disposed between the rotating drum 30 and the rear driving roller 32. This tension sensor S34 can be configured, for example, by a load cell that detects a force received from the sheet S. Then, on the basis of a detection result of the tension sensor S34, the printer control unit 100 performs feedback control of the torque of the rear driving motor M32, and adjusts the processing tension Tb of the sheet S. More specifically, a table showing target processing tensions Tbt that accord with a type and width of the sheet S, is stored in advance in the printer control unit 100. Then, the printer control unit 100 selects, from the table, the target processing tension Tbt corresponding to the type and the width of sheet S to be transported, and performs the feedback control of the torque of the rear driving motor M32, such that the processing tension Tb detected by the tension sensor S34 approaches the selected target processing tension Tbt. Incidentally, the target processing tension Tbt is set to a value greater than the target feed tension Tat.

Further, the printer control unit 100 rotates the winding motor M40 that drives the winding shaft 40, and winds, onto the winding shaft 40, the sheet S transported by the rear driving roller 32. At this time, the printer control unit 100 controls the torque of the winding motor M40 and adjusts a tension (a winding tension Tc) of the sheet S from the rear driving roller 32 to the winding shaft 40. Specifically, a tension sensor S41 that detects the winding tension Tc is attached to the driven roller 41 disposed between the rear driving roller 32 and the winding shaft 40. This tension sensor S41 can be configured, for example, by a load cell that detects a force received from the sheet S. Then, on the basis of a detection result of the tension sensor S41, the printer control unit 100 performs feedback control of the torque of the winding motor M40, and adjusts the winding tension Tc of the sheet S. Specifically, a target winding tension Tct, which has been input by the user via the UI 9, is stored in the printer control unit 100. Then, the printer control unit 100 performs the feedback control of the torque of the feed motor M40, such that the winding tension Tc detected by the tension sensor S41 approaches the target winding tension Tct. At this time, to perform tapering tension that changes the winding tension Tc depending on the diameter of the winding roll R40, the target winding tension Tct is adjusted depending on the diameter of the winding roll R40.

Incidentally, as described above, the speed control is performed on the front driving motor M31 that drives the front driving roller 31. Specifically, the printer control unit 100 performs the feedback control on the basis of an output of an encoder of the front driving motor M31, and thus rotates the front driving motor M31 at a specific rotational speed V. In this way, the sheet S is transported in the transport direction Ds at the circumferential speed of the front driving roller 31 rotating at the rotational speed V.

However, depending on transport conditions of the sheet S, the transport speed of the sheet S on the circumferential surface of the rotating drum 30 is sometimes faster than the transport speed of the sheet S on the circumferential surface of the front driving roller 31, as discovered by experiments (to be described later) by the inventors. In this case, discharging the ink appropriately from the recording heads 51 and 52 sometimes becomes difficult. Specifically, as can be seen from FIG. 3, when the transport speed of the sheet S at the rotating drum 30 becomes fast, the time interval of the continuously generated pts becomes short, and the time interval of the voltage signals applied continuously to the nozzles of the recording heads 51 and 52 also becomes short. In contrast to this, each of the voltage signals changes over a specific period of time. Thus, if the time interval of the voltage signals is too short, the continuous voltage signals temporally overlap with each other, and the ink cannot be appropriately discharged from the recording heads 51 and 52.

Here, the printer control unit 100 adjusts the rotational speed of the front driving roller 31 in accordance with the transport conditions of the sheet S, in particular, in accordance with a linear pressure Pl applied to the sheet S at a wrapped around section on the front driving roller 31. Specifically, the printer control unit 100 determines the rotational speed V of the front driving roller 31, namely, the rotational speed V of the front driving motor M31 that drives the front driving roller 31, on the basis of the following equations:

$$V=(100\ [\%]-\Delta V\ [\%])\times Vr \qquad \text{Equation 1}$$

$$\Delta V=a\times Pl+b \qquad \text{Equation 2}$$

$$Pl\ [\text{N/mm}]=(Tbt-Tat)/W \qquad \text{Equation 3.}$$

As shown in Equation 3, the printer control unit 100 calculates the linear pressure Pl applied to the sheet S on the front driving roller 31 by dividing a target tension difference (Tbt−Tat>0), which is obtained by subtracting the target feed tension Tat [N] from the target processing tension Tbt [N], by the width W [mm] of the sheet S. At this time, a value calculated from the detection result of the paper width sensor Sw is used as the width W of the sheet S. Then, as shown in Equation 2, the printer control unit 100 calculates a control amount ΔV [%] from a linear equation having the linear pressure Pl as a variable, where the coefficients a and b each denote a gradient and an intercept (a>0, b>0). Further, as shown in Equation 1, the printer control unit 100 calculates the rotational speed V by multiplying a proportion, which is obtained by subtracting the control amount ΔV [%] from 100 [%], by a reference rotational speed Vr. Here, the reference rotational speed Vr is a rotational speed of the front driving motor M31 in an ideal state at which the circumferential speed of the front driving roller 31 matches the circumferential speed of the rotating drum 30.

Then, the printer control unit 100 calculates the rotational speed V in advance, before starting the transport of the sheet S. Then, when transporting the sheet S, the printer control unit 100 performs feedback control of the front driving motor M31 on the basis of the output of the encoder of the front driving motor M31, and thus rotates the front driving motor M31 at the rotational speed V. As seen from Equations 1 to 3, the rotational speed V of the front driving motor M31 decreases as the linear pressure Pl increases. Specifically, as the linear pressure Pl increases, the printer control unit 100 decreases the rotational speed V of the front driving roller 31, namely, the rotational speed V of the front driving motor M31 that drives the front driving roller 31. In other words, as demonstrated by the experiments described below, a difference between the circumferential speed of the rotating drum 30 and the circumferential speed of the front driving roller 31 tends to increase along with the increase in the linear pressure Pl. Here, the printer control unit 100 performs the above-described control so as to appropriately restrict the circumferential speed of the rotating drum 30.

Further, the printer control unit 100 stores a table in which the coefficients a and b are set depending on the type of sheet S. FIG. 4 is a diagram illustrating an example of a table showing relationships between sheet types and the coefficients a and b. As illustrated in FIG. 4, the coefficients a and b of different combinations when the sheet S includes paper and when the sheet S does not include paper are used in the calculations based on Equation 2. In other words, as demonstrated by the experiments described below, the difference between the circumferential speed of the rotating drum 30 and the circumferential speed of the front driving roller 31 may depend on the type of sheet S. Here, to appropriately restrict the circumferential speed of the rotating drum 30, the printer control unit 100 adjusts the rotational speed V of the front driving roller 31, namely, the rotational speed V of the front driving motor M31 that drives the front driving roller 31, in accordance with the type of sheet S.

In the exemplary embodiment, as described above, the rotational speed V of the front driving roller 31 is adjusted in accordance with the linear pressure Pl applied to the sheet S on the front driving roller 31. Thus, the transport speed of the sheet S supported on the circumferential surface of the rotating drum 30 can be suppressed to an appropriate range.

Further, depending also on the type of sheet S, the circumferential speed of the rotating drum 30 is sometimes faster than the circumferential speed of the front driving roller 31. In response to this, the rotational speed V of the front driving roller 31 is adjusted in accordance with the type of sheet S. In this way, the transport speed of the sheet S on the rotating drum 30 can be more reliably suppressed to the appropriate range.

Figure 5:
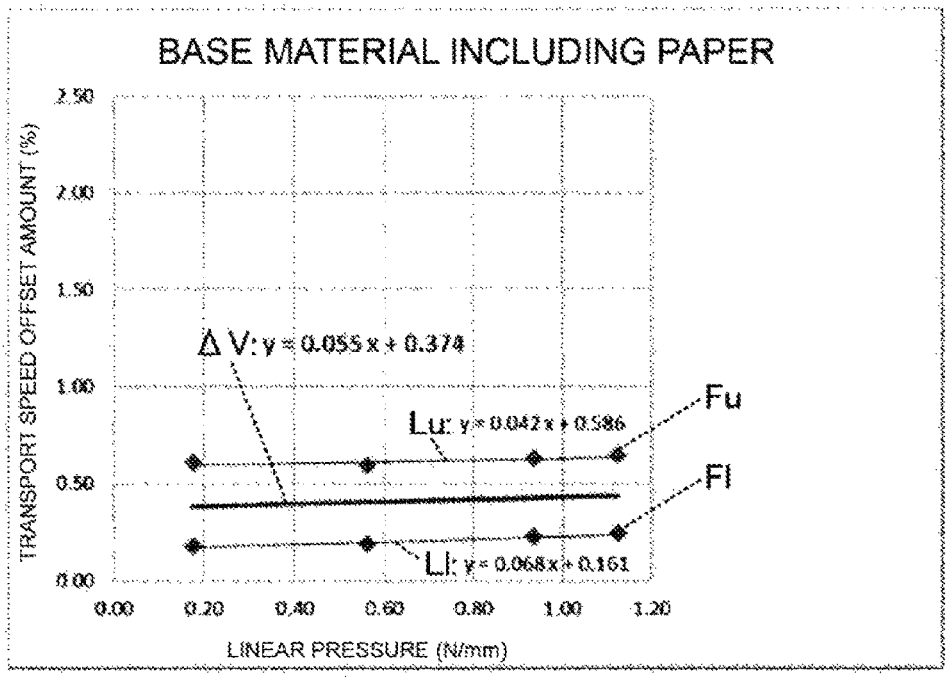
FIG. 5 is a diagram illustrating a relationship between a speed difference between a front driving roller and a rotating drum, and a linear pressure.
Figure 6:
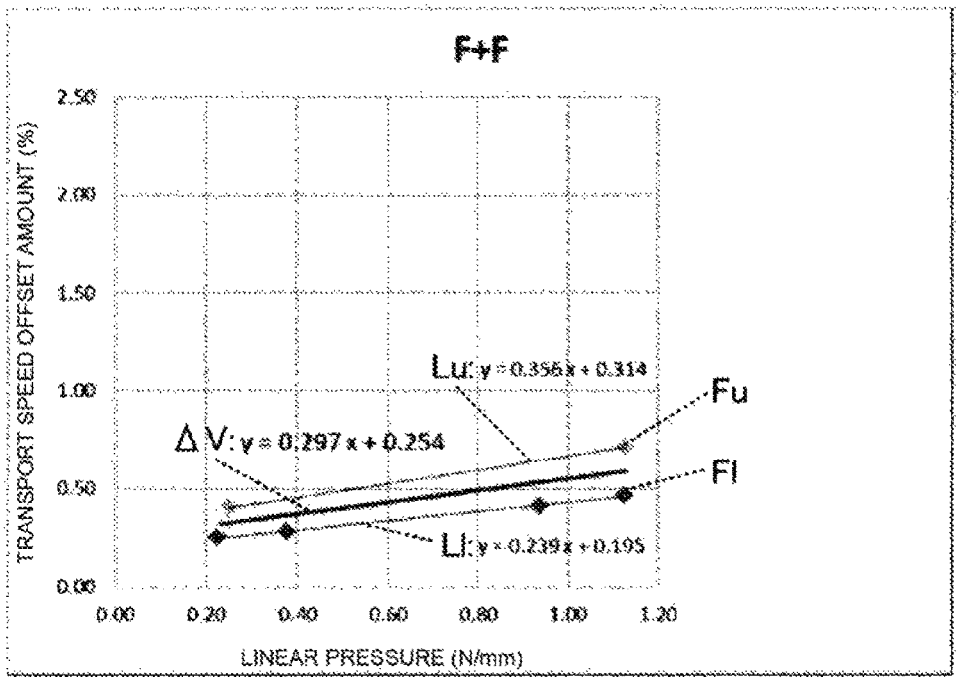
FIG. 6 is a diagram illustrating the relationship between the speed difference of the front driving roller and the rotating drum, and the linear pressure.
Figure 7:
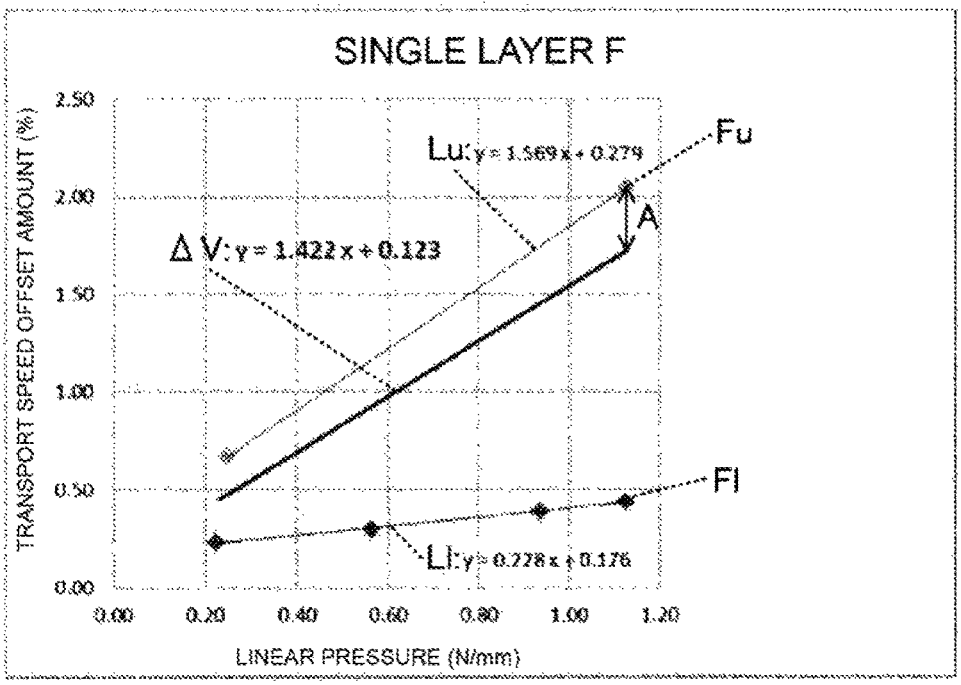
FIG. 7 is a diagram illustrating the relationship between the speed difference of the front driving roller and the rotating drum, and the linear pressure.

Next, an experiment relating to the speed difference between the front driving roller 31 and the rotating drum 30, and a method for calculating specific values of the coefficients a and b shown in FIG. 4 from results of this experiment, will be described. FIG. 5, FIG. 6, and FIG. 7 are diagrams showing relationships between the speed difference between the front driving roller 31 and the rotating drum 30, and the linear pressure Pl. In particular, FIG. 5 shows a case in which the sheet S (the base material) includes paper, FIG. 6 shows a case in which the type of sheet S is "F+F," and FIG. 7 shows a case in which the type of sheet S is the "single layer F." Further, in each of the drawings, a horizontal axis shows the linear pressure Pl, and a vertical axis shows a transport speed offset amount [%]. This transport speed offset amount is a value obtained by dividing a circumferential speed difference, which is obtained by subtracting the circumferential speed of the front driving roller 31 from the circumferential speed of the rotating drum 30, by the circumferential speed of the front driving roller 31, and is expressed as a percentage. Note that the circumferential speed of the rotating drum 30 is calculated from the output value of the drum encoder E30 and the diameter of the rotating drum 30, and the circumferential speed of the front driving roller 31 is calculated from the output value of the encoder of the front driving motor M31 and the diameter of the front driving roller 31.

Content of the experiment will be described using FIG. 5 as a representative example. In this experiment, the transport conditions shown below were changed, within a variation range, under assumed usage conditions of the printer 1:

- Type of sheet S: "paper+paper"/"single layer paper"/"F+paper"
- Thickness of sheet S
- Width W of sheet S
- Target feed tension Tat
- Temperature of rotating drum 30
- Rotational speed V of front driving motor M31
- Surface of sheet S (top surface/back surface) facing recording heads 51 and 52.

Then, the transport speed offset amount was measured. In this way, for a given linear pressure Pl, an upper limit Fu and a lower limit Fl of a fluctuation range of the transport speed offset amount are calculated. Then, by performing measurements for each of the differing linear pressures Pl, the offset upper limits Fu and the offset lower limits Fl are calculated. As can be seen from the results in FIG. 5, the transport speed offset amount is always positive, and the circumferential speed of the rotating drum 30 is always faster than the circumferential speed of the front driving roller 31.

Next, an approximation straight line (Lu: $y=0.042x+0.586$) of each of the offset upper limits Fu for the different linear pressures Pl, and an approximation straight line (Ll: $y=0.068x+0.161$) of each of the offset lower limits Fl for the different linear pressures Pl are calculated. Here, in the approximation straight lines in the drawings, the linear pressure Pl is denoted as the variable "x" and the transport speed offset amount is denoted as the variable "y". Since the gradient of both the upper limit approximation straight line Lu and the lower limit approximation straight line Ll are positive, in accordance with the increase in the linear pressure Pl, the transport speed offset amount increases, namely, the speed difference between the circumferential speed of the rotating drum 30 and the circumferential speed of the front driving roller 31 increases. Thus, if the linear pressure Pl is increased while the rotational speed of the front driving motor M31 is kept constant, the circumferential speed of the rotating drum 30 increases, and finally, may become too fast.

When the upper limit approximation straight line Lu and the lower limit approximation straight line Ll are calculated in this way, the above-described linear equation (Equation 2) that gives the control amount ΔV can be solved on the basis of Lu and Ll. Specifically, the linear equation of the control amount ΔV is solved such that a restriction condition is satisfied, namely, that a difference [%] between the upper limit approximation straight line Lu and the control amount ΔV is less than an allowable offset amount A. Here, the allowable offset amount A is a value obtained by adding a specific margin to an offset amount at which the drive signals continuously output in synchronization with the pts start to temporally overlap with each other. In the example in FIG. 5, the linear equation of the control amount ΔV ($y=0.055x+0.374$) is set midway between the upper limit approximation straight line Lu and the lower limit approximation straight line Ll. Then, the gradient and the intercept of this linear equation are calculated as the coefficients a and b of the "sheet S including paper" in the table shown in FIG. 4.

The same experiment was also carried out for the sheet S of "F+F" and "single layer F." Note that, of the transport conditions listed above, the type of sheet S is fixed to the type corresponding to each of the experiments. In this way, at the same time as solving the linear equation of the control amount ΔV, the coefficients a and b are also calculated.

Incidentally, for the "F+F" sheet S in FIG. 6, the linear equation of the control amount ΔV (y=0.297x+0.254) is set midway between the upper limit approximation straight line Lu and the lower limit approximation straight line Ll as illustrated in FIG. 5. In contrast to this, for the "single layer F" in FIG. 7, since the above-described restriction condition is not satisfied by the same setting method, while an end on the minimum side of the linear pressure Pl of the control amount ΔV is set to a value midway between the upper limit approximation straight line Lu and the lower limit approximation straight line Ll, an end on the maximum side of the linear pressure Pl of the control amount ΔV is set to a value obtained by subtracting the allowable offset amount A from the upper limit approximation straight line Lu.

Then, as described above, a rotational speed (=ΔV×Vr) depending on the control amount ΔV calculated in this way is subtracted from the reference rotational speed Vr, and the obtained value is set as the rotational speed V of the front driving motor M31. As a result, even if the above-described transport conditions have changed, the control is performed such that the transport speed offset amount does not exceed the allowable offset amount A, and the circumferential speed of the rotating drum 30 can be suppressed to the appropriate range. Thus, the discharge of the ink from the recording heads 51 and 52 can be appropriately performed.

In the above-described exemplary embodiment, the printer 1 corresponds to an example of a "printing apparatus" of the invention, the front driving roller 31 corresponds to an example of a "driving roller" of the invention, the recording heads 51 and 52 correspond to an example of a "discharging head" of the invention, the rotating drum 30 corresponds to an example of a "driven rotational member" of the invention, the drum encoder E30 corresponds to an example of a "rotation position detection unit" of the invention, the printer control unit 100 corresponds to an example of a "control unit" or a "tension adjustment unit" of the invention, the sheet S corresponds to an example of a "recording medium" of the invention, the ink corresponds to an example of "liquid" of the invention, the target processing tension Tbt corresponds to an example of a "first target tension" of the invention, and the target feed tension Tat corresponds to an example of a "second target tension" of the invention.

Figure 8:
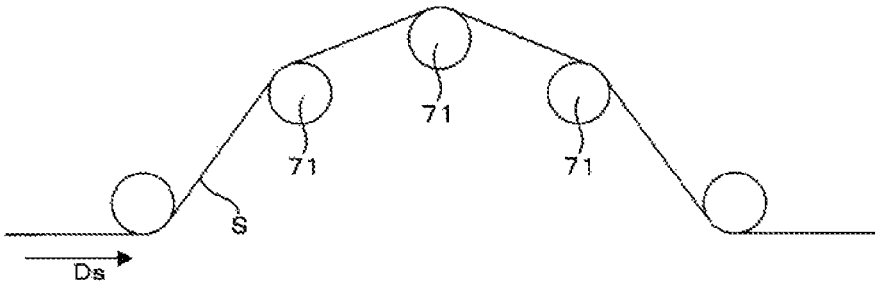
FIG. 8 is a diagram illustrating a modified example of a mode of supporting a sheet.
Figure 9:
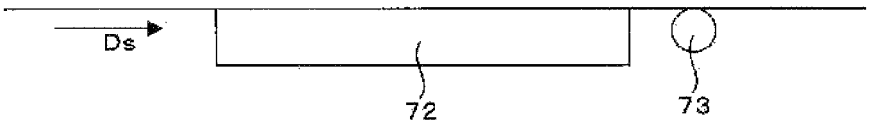
FIG. 9 is a diagram illustrating a modified example of a mode of supporting the sheet.

Note that, the invention is not limited to the above-described exemplary embodiment, and various modifications can be made to the above-described exemplary embodiment without departing from the spirit and gist of the invention. For example, in the above-described exemplary embodiment, the cylindrical rotating drum 30 supports the sheet S. However, a mode of supporting the sheet S is not limited to this example. FIG. 8 and FIG. 9 are diagrams schematically illustrating modes of supporting the sheet S according to modified examples.

In an example in FIG. 8, the sheet S is stretched over a plurality of support rollers 71, and a recording head (not illustrated) faces each of the support rollers 71 with the sheet S therebetween. In this way, the support rollers 71 are driven to rotate by the transport of the sheet S, while supporting the sheet S at sections at which the ink discharged from the recording heads impacts the sheet S. Then, a discharge timing of each of the recording heads is controlled on the basis of a result of a rotation position of the facing support roller 71 detected by an encoder. The invention can also be applied to the printer 1 that supports the sheet S using this type of mode of support, to deal with a difference between the circumferential speeds of the front driving roller 31 and the support rollers 71.

In an example in FIG. 9, a support plate 72 supports the sheet S, and a plurality of recording heads (not illustrated) face the support plate 72 with the sheet S therebetween. Further, a driven roller 73 driven to rotate due to the transport of the sheet S is provided on the downstream side of the support plate 72 in the transport direction Ds. Then, a discharge timing of each of the recording heads is controlled on the basis of a result of a rotation position of the driven roller 73 detected by an encoder. The invention can also be applied to the printer 1 that supports the sheet S using this type of mode of support, to deal with a difference between the circumferential speeds of the front driving roller 31 and the driven roller 73.

Further, in the above-described exemplary embodiment, the speed control is performed with respect to the front driving motor M31 of the driving roller 31. However, the invention may be applied to the printer 1 that performs the torque control on the front driving motor M31 of the front driving roller 31, and performs the speed control on the rear driving motor M32 of the rear driving roller 32.

Further, the width W of the sheet S used when the linear pressure Pl is calculated is calculated on the basis of the detection value of the paper width sensor Sw. However, the linear pressure Pl may be calculated using the width W of the sheet S input by the user via the UI 9.

Further, in the above Equation 3, the linear pressure Pl is calculated by dividing the target tension difference (Tbt−Tat>0), which is obtained by subtracting the target feed tension Tat [N] from the target processing tension Tbt [N], by the width W [mm] of the sheet S. However, the linear pressure Pl may be calculated by dividing the tension difference (Tb−Ta>0), which is obtained by subtracting the feed tension Ta [N] measured by the tension sensor S21 from the processing tension Tb [N] measured by the tension sensor S34, by the width W [mm] of the sheet S.

Further, in FIG. 4, with respect to the sheet S that does not include paper, the values of the coefficients a and b differ depending on whether the type of sheet S is "F+F" or "single layer F." However, with respect to the sheet S that does not include paper, experiments revealed that values of the appropriate coefficients a and b differed depending on whether or not the sheet S includes polyethylene terephthalate (PET).

Therefore, with respect to the sheet S that does not include paper, the values of the coefficients a and b may be caused to be different depending on whether or not the sheet S includes PET as a material.

This application claims priority under 35 U.S.C. §119 to Japanese Patent Application No. 2016-114927, filed Jun. 9, 2016. The entire disclosure of Japanese Patent Application No. 2016-114927 is hereby incorporated herein by reference.

What is claimed is:

1. A printing apparatus comprising:

a driving roller configured to transport a recording medium by rotation of the driving roller while being in contact with the recording medium;

a discharging head configured to discharge liquid onto the recording medium;

a driven rotational member configured to be driven to rotate as a result of transport of the recording medium while being in contact with the recording medium;

a rotation position detection unit configured to detect a rotation position of the driven rotational member; and a control unit configured to rotate the driving roller to transport the recording medium and adjust a timing of discharging the liquid from the discharging head in accordance with a detection result of the rotation position detection unit, the control unit adjusting a rotational speed of the driving roller in accordance with a linear pressure applied to the recording medium on the driving roller.

2. The printing apparatus according to claim 1, wherein the recording medium is wrapped around and supported on a circumferential surface of the driven rotational member, and the discharging head discharges the liquid onto the recording medium wrapped around the driven rotational member.

3. The printing apparatus according to claim 1, further comprising:

a tension adjustment unit configured to adjust a tension of the recording medium on a side closer to the discharging head than the driving roller to a first target tension T1, and also adjust a tension of the recording medium on the opposite side to the discharging head with respect to the driving roller to a second target tension T2, the second target tension T2 being smaller than the first target tension T1, wherein the control unit adjusts the rotational speed of the driving roller in accordance with a linear pressure Pl calculated using an expression $$(T1-T2)/W,$$

where a difference between the first target tension T1 and the second target tension T2 is divided by a width of the recording medium.

4. The printing apparatus according to claim 2, further comprising:

a tension adjustment unit configured to adjust a tension of the recording medium on a side closer to the discharging head than the driving roller to a first target tension T1, and also adjust a tension of the recording medium on the opposite side to the discharging head with respect to the driving roller to a second target tension T2, the second target tension T2 being smaller than the first target tension T1, wherein the control unit adjusts the rotational speed of the driving roller in accordance with a linear pressure Pl calculated using an expression $$(T1-T2)/W,$$

where a difference between the first target tension T1 and the second target tension T2 is divided by a width of the recording medium.

5. The printing apparatus according to claim 3, wherein the control unit uses a coefficient a and a coefficient b, the coefficient a and the coefficient b each being greater than zero, and adjusts the rotational speed of the driving roller in accordance with a control amount calculated using an expression $$a \times Pl+b,$$

and also changes at least one of the coefficient a and the coefficient b in accordance with a type of the recording medium.

6. The printing apparatus according to claim 4, wherein the control unit uses a coefficient a and a coefficient b, the coefficient a and the coefficient b each being greater than zero, and adjusts the rotational speed of the driving roller in accordance with a control amount calculated using an expression $$a \times Pl+b,$$

and also changes at least one of the coefficient a and the coefficient b in accordance with a type of the recording medium.

7. The printing apparatus according to claim 5, wherein the coefficient a used when a recording medium that does not include paper is used as the recording medium is greater than the coefficient a used when a recording medium that includes paper is used as the recording medium, and the coefficient b used when a recording medium that does not include paper is used as the recording medium is less than the coefficient b used when a recording medium that includes paper is used as the recording medium.

8. The printing apparatus according to claim 6, wherein the coefficient a used when a recording medium that does not include paper is used as the recording medium is greater than the coefficient a used when a recording medium that includes paper is used as the recording medium, and the coefficient b used when a recording medium that does not include paper is used as the recording medium is less than the coefficient b used when a recording medium that includes paper is used as the recording medium.

9. A printing method comprising:

transporting a recording medium by rotating a driving roller in contact with the recording medium, and also detecting a rotation position of a driven rotational member driven to rotate as a result of transport of the recording medium while being in contact with the recording medium; and adjusting a timing of discharging liquid from a discharging head on the recording medium in accordance with a detection result of the rotation position of the driven rotational member, a rotational speed of the driving roller being adjusted in accordance with a linear pressure applied to the recording medium on the driving roller.

* * * * *